US007036227B2

(12) United States Patent
Ling et al.

(10) Patent No.: US 7,036,227 B2
(45) Date of Patent: May 2, 2006

(54) PROCESS FOR MAKING RATCHET WHEELS

(76) Inventors: David Ling, P.O. Box 63-247, Taichung (TW); Hsien Chung Tuan-Mu, P.O. Box 63-247, Taichung (TW)

( * ) Notice: Subject to any disclaimer, the term of this patent is extended or adjusted under 35 U.S.C. 154(b) by 36 days.

(21) Appl. No.: 10/774,120

(22) Filed: Feb. 6, 2004

(65) Prior Publication Data

US 2005/0173090 A1 Aug. 11, 2005

(51) Int. Cl.
*B21D 53/28* (2006.01)
*B23D 37/00* (2006.01)

(52) U.S. Cl. ..... 29/893.33; 29/893.34; 29/893.35; 29/894; 29/558; 409/243; 409/244

(58) Field of Classification Search ..... 29/894, 29/893.33, 893.34, 893.35, 557, 558; 72/370.13, 72/355.2, 352, 354.2, 352.2; 409/243–244; 81/60–63.2; 407/13–18
See application file for complete search history.

(56) References Cited

U.S. PATENT DOCUMENTS 1,375,767 A * 4/1921 Baldus ..... 72/324
2,340,529 A * 2/1944 Hartman ..... 72/338
2,457,451 A * 12/1948 Domack ..... 76/114
2,537,175 A * 1/1951 Viets ..... 81/58.2
2,623,418 A * 12/1952 Vaughan ..... 76/114
2,774,259 A * 12/1956 Caulkins ..... 72/341
5,983,758 A * 11/1999 Tanner ..... 81/124.3
6,390,929 B1 * 5/2002 Hyatt ..... 470/8
6,422,053 B1 * 7/2002 Greuel et al. ..... 72/397
6,701,768 B1 * 3/2004 Ling et al. ..... 72/356
2001/0054334 A1 12/2001 Ling et al.
2002/0148329 A1 10/2002 Ling et al.

* cited by examiner

*Primary Examiner*—Eric Compton
(74) *Attorney, Agent, or Firm*—Nelson Mullins Riley & Scarborough, LLP

(57) ABSTRACT

A process for manufacturing ratchet wheels including the steps of: forming a cylindrical forging billet by hot or cold forging, the forging billet having a thru hole of inter-communicating recesses which are pre-formed in a forging die; providing a broach having teeth formed thereon; machining the forging billet into a workpiece having a sidewall with two annular grooves on the sidewall; forming a semi-product having a driving recess which is complementary in shape to the teeth by operating the broach through the workpiece along the thru hole; and forming a finished product having a plurality of teeth on a sidewall thereof by milling the semi-product.

2 Claims, 14 Drawing Sheets

PROCESS FOR MAKING RATCHET WHEELS

FIELD OF THE INVENTION

The present invention relates to a process for making ratchet wheels, particularly to a process that can increase the yields of ratchet wheels.

BACKGROUND OF THE INVENTION

Patent application Ser. No. 09/820,061 discloses a process for making ratchet wheels comprising the steps of punching a large recess and a small recess in a workpiece at one time by a special punch. The workpiece is then subject to further punching steps to form a recess and an opening. Thereafter a part of the workpiece with the later-formed recess and opening is cut away. The workpiece is then processed with the steps of defining two annular grooves in a periphery of the workpiece and forming a plurality of teeth on the workpiece.

According to the present invention, the above process is improved in a more cost-effective way to improve the yields.

SUMMARY OF THE INVENTION

According to a first aspect of the invention, the conventional process of making ratchet wheels can be improved by lost wax casting so as to increase the yields.

According to a second aspect of the invention, the conventional process of making ratchet wheels can be improved by using a powder injection molding process.

According to a third aspect of the invention, the conventional process of making ratchet wheels can be improved by using a powder metallurgy.

According to a forth aspect of the invention, the conventional process of making ratchet wheels can be improved by using a broaching process.

According to a fifth aspect of the invention, the conventional process of making ratchet wheels can be improved by using a simplified punching process.

DETAILED DESCRIPTION OF PREFERRED EMBODIMENT

Lost Wax Casting

FIGS. 1A to 1M illustrate a process of manufacturing ratchet wheels by lost wax casting.

Figure 1B:
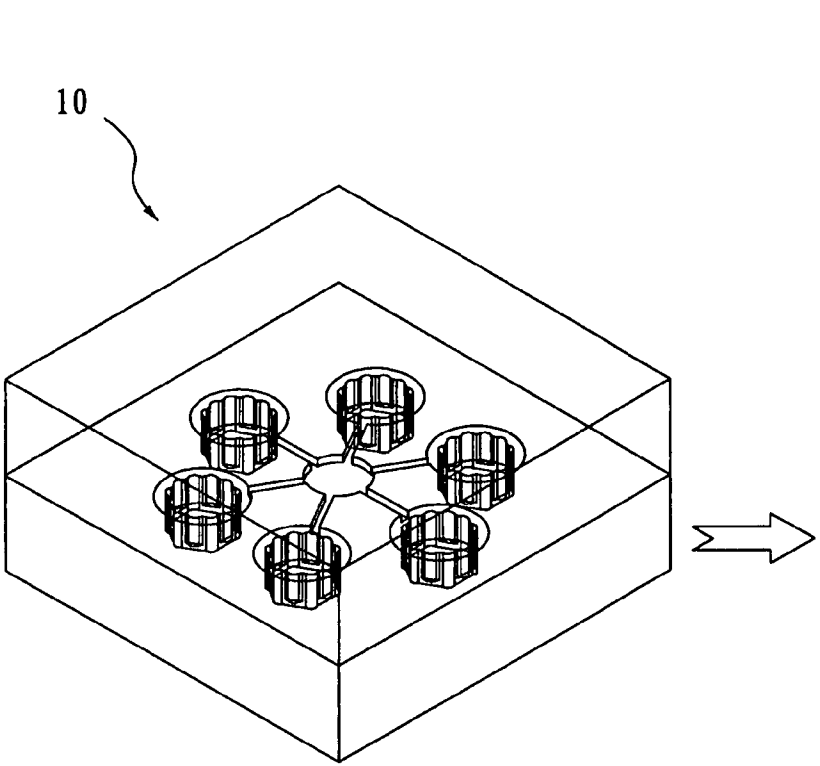
FIGS. 1A to 1M illustrate the manufacturing of ratchet wheels by using a lost wax casting process.
Figure 1A:
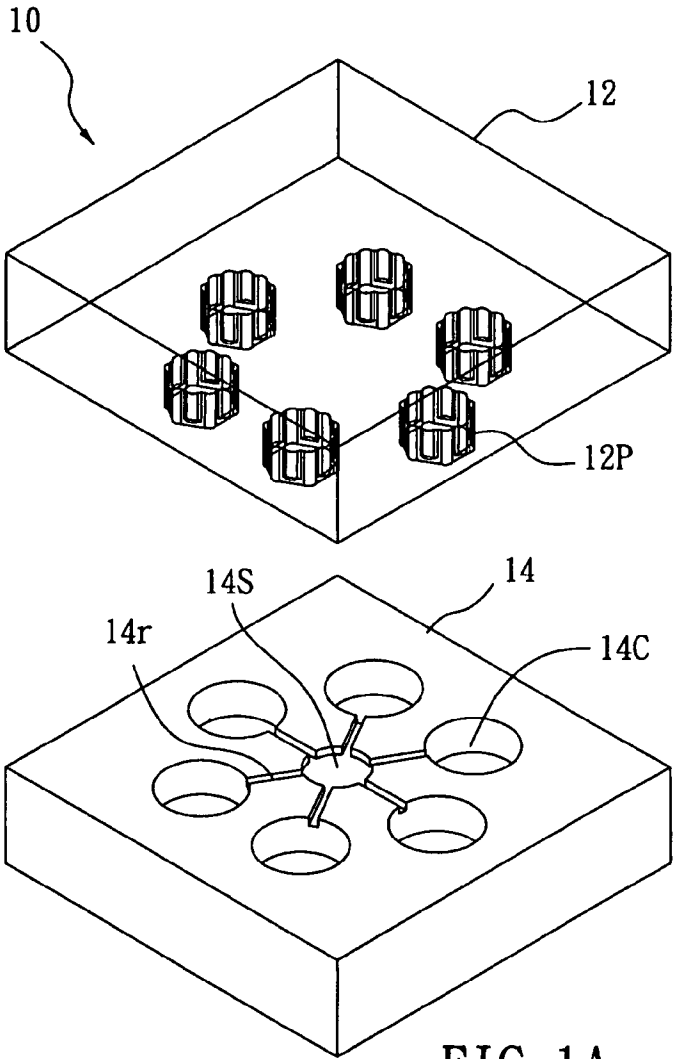

Referring to FIG. 1A, a master mold 10 consisting of upper and lower mold parts 12, 14 is created. The upper mold part 12 is provided with a number of preferably annularly-disposed posts 12*p* each of which has a sidewall which is complementary in shape to a driving recess 62 of a finished product 60 (see FIG. 1M). Preferably, each of the sidewall of posts 12*p* has a dodecagonal cross section such that the driving recess 62 of the finished product 60 is in a dodecagonal shape. The lower mold 14 comprises a number of round cavities 14*c* corresponding to the posts 12*p*, and preferably a common sprue 14*s* and runners 14*r* communicating between the common sprue 14*s* and the round cavities 14*c*. The posts 12*p* are designed for being inserted into the corresponding round cavities 14*c* formed on the lower mold part 14 such that the upper and lower mold parts 12, 14 define a wax pouring space therebetween when assembled together. The wax pouring space comprises a number of annular pouring cavities defined by the posts 12*p* and their respective round cavities 14*c*.

Figure 1D:
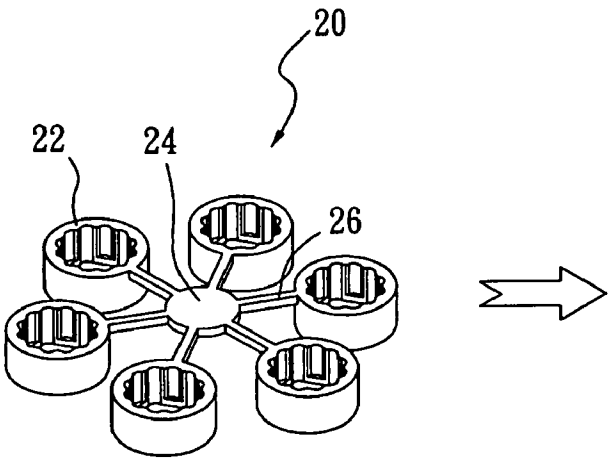
Figure 1C:
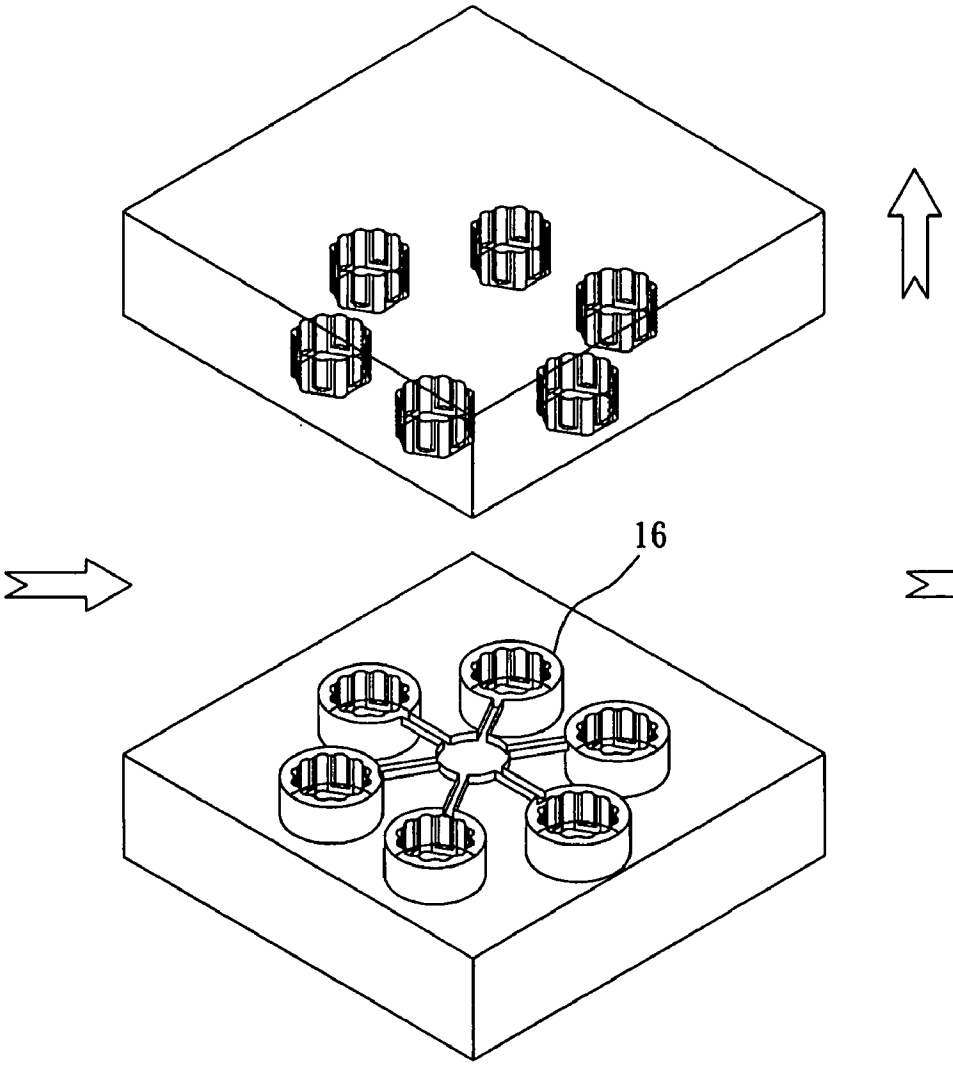

As shown in FIG. 1B, the upper and lower mold parts 12, 14 are then assembled together and melt wax is injected into the cavities between the mold parts 12, 14. Thereafter, as shown in FIGS. 1C to 1D, after the wax is solidified, the upper and lower mold parts 12, 14 are separated apart so as to obtain a finished wax pattern 20 carrying a number of wax imprints 22 of the cast product 40, a common sprue part 24, and branches 26 connecting the wax imprints 22 and the common sprue part 24 together.

Figure 1F:
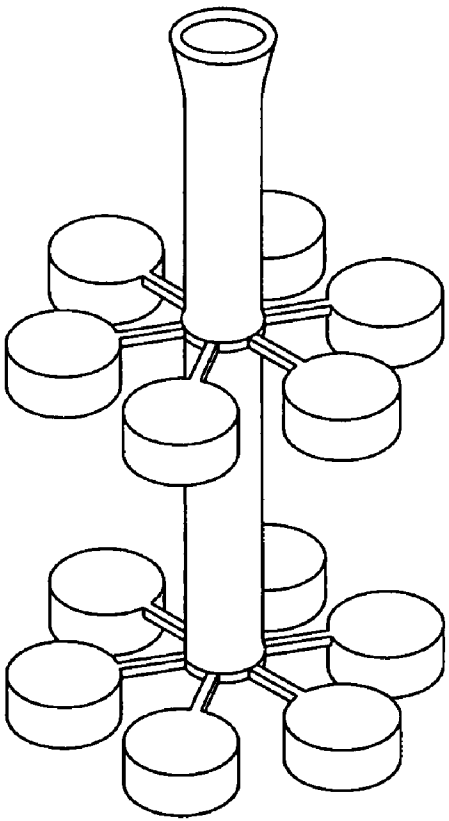
Figure 1E:
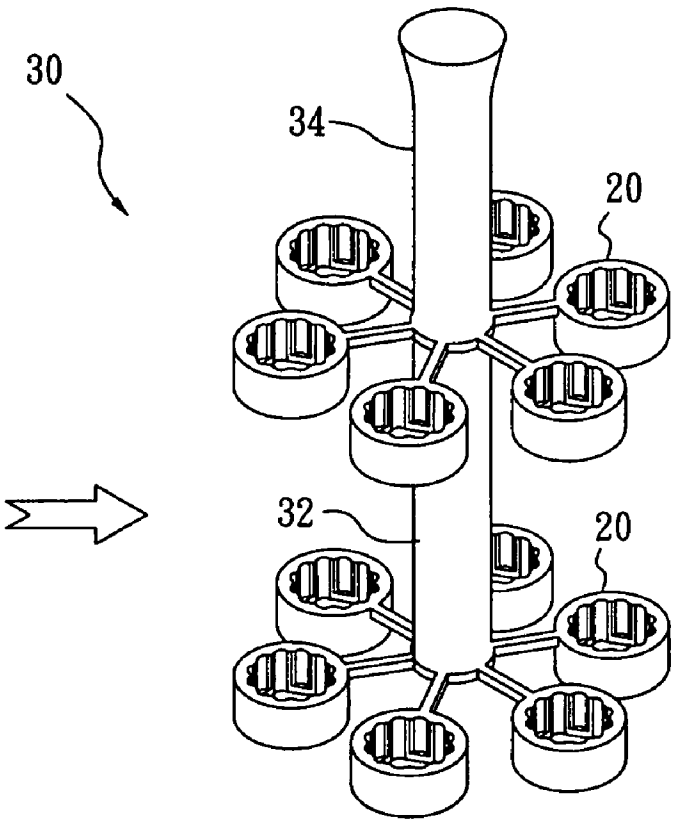

Referring to FIG. 1E, a pattern tree 30 is then established by stacking a number of wax patterns 20 made according to the above steps atop one another via wax rod(s) 32 which connects the common sprue parts 24 of the individual wax patterns 20 together. A funnel-shaped rod 34 is attached to the top wax pattern 20.

As shown in FIG. 1F, the pattern tree 30 of FIG. 1E is then dipped into a slurry. The pattern tree 30 coated with slurry is then dried such as by air, and a shell is thus formed when the slurry has hardened. It is then dewaxed by heat. All that is left of the pattern tree is a cavity bearing an exact imprint of the original.

Figure 1G:
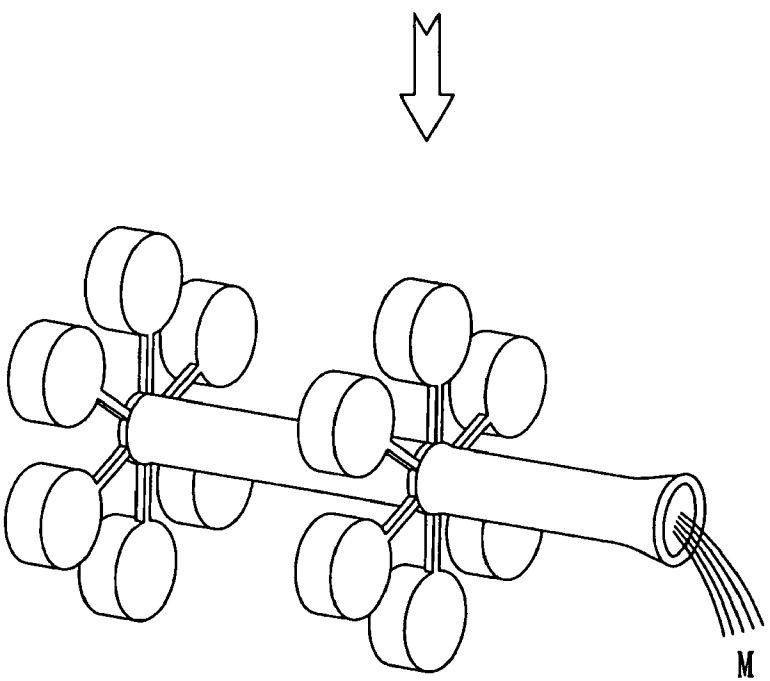
Figure 1H:
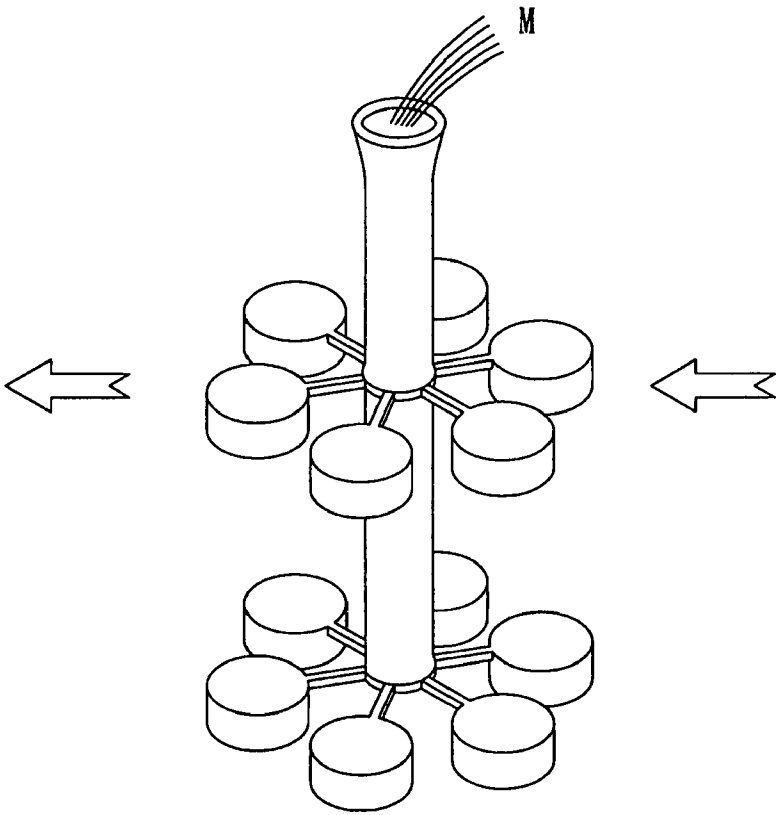

Referring to FIGS. 1G to 1H, molten metal M is then poured into this cavity.

Figure 1I:
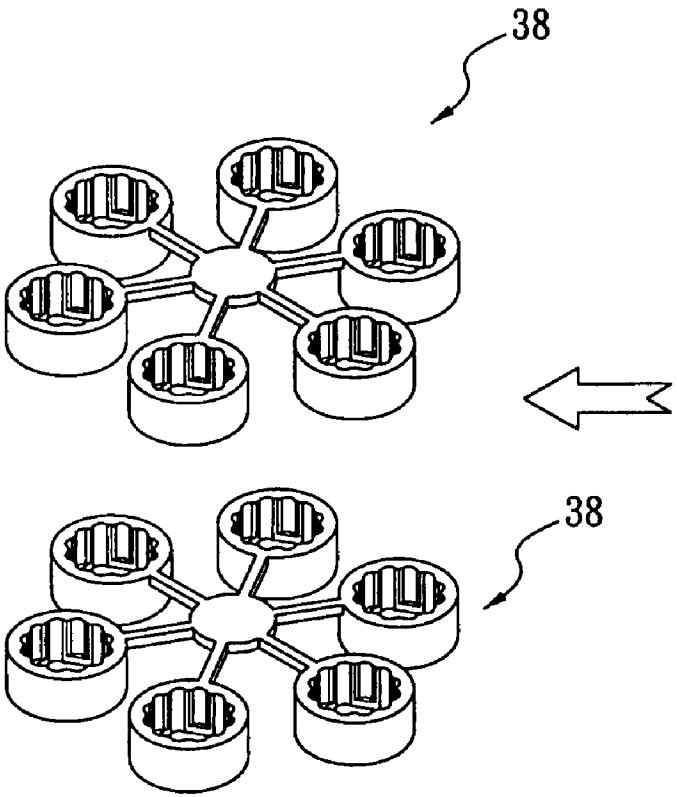
Figure 1J:
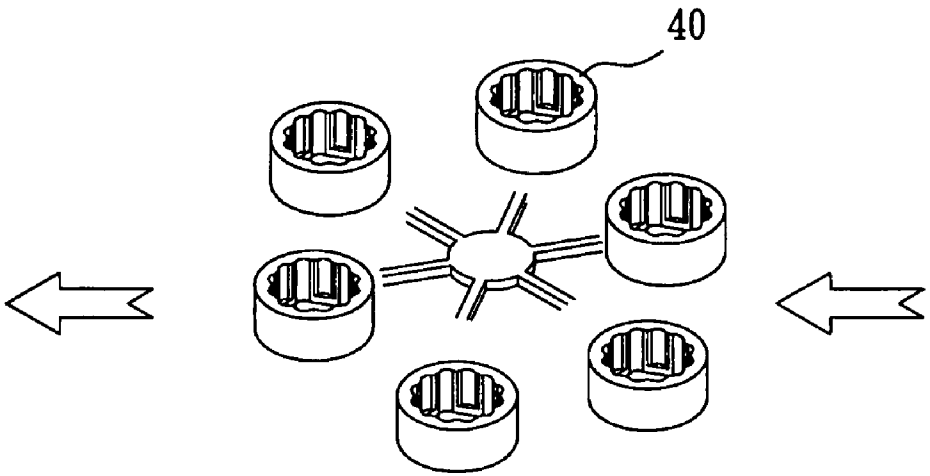
Figure 1K:
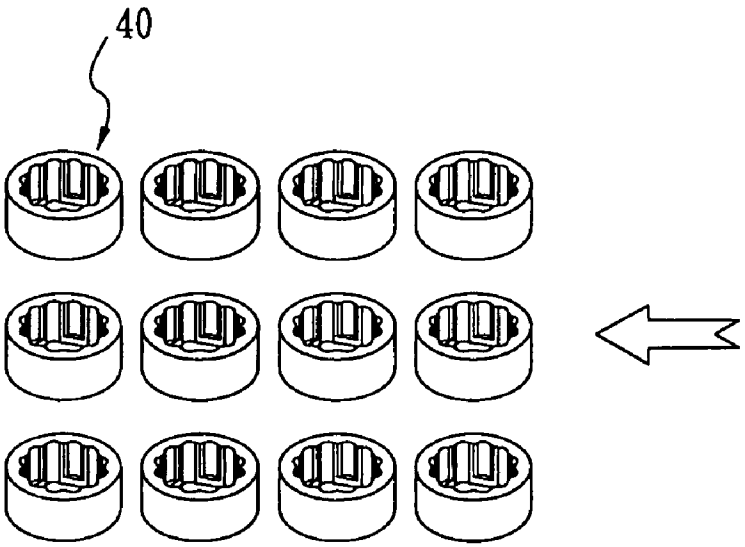

After the molten metal solidifies, cast products 40 are formed inside the shell. As shown in FIG. 1I, the shell is then destroyed such that the cast works 38 can be removed from the inside of the shell. Thereafter, the links of the cast product, which result from the sprue parts 24 and branches 26 of the wax pattern, are removed (FIG. 1J) so as to obtain the final cast products 40 (FIG. 1K).

Figure 1L:
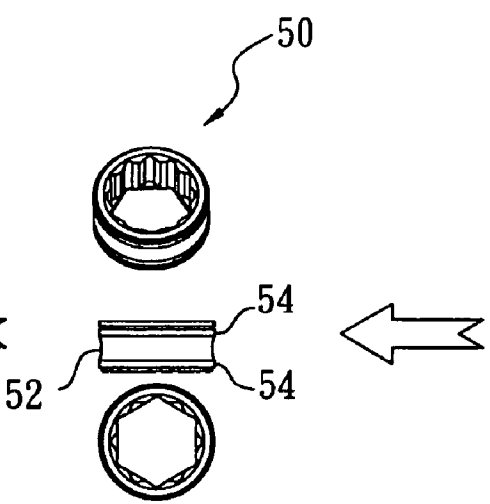
Figure 1M:
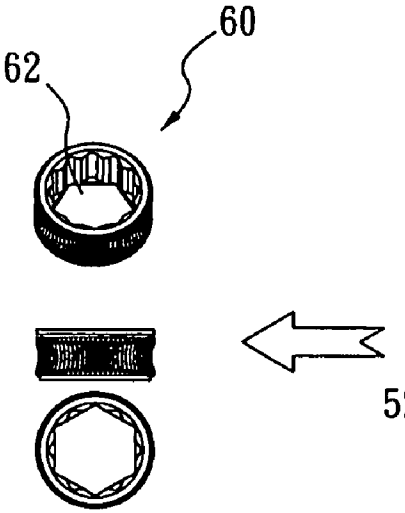

Referring to FIGS. 1L and 1M, each of the cast products 40 is processed by means of a CNC lathe (not shown) in order to define two annular grooves 54 in a sidewall 52 thereof such that it is made into an annular semi-product 50. The semi-product 50 is processed so as to define a plurality of teeth in the sidewall by further machining steps such as by milling. Therefore, the semi-product is made a finished product 60. If necessary, the finished product 60 can be further processed with heat-treating step(s) to obtain the desired mechanical property.

Powder Injection Molding

A powder injection molding process as shown in FIGS. 2A to 2I is an alternative for manufacturing ratchet wheels.

Figures 2A, 2B:
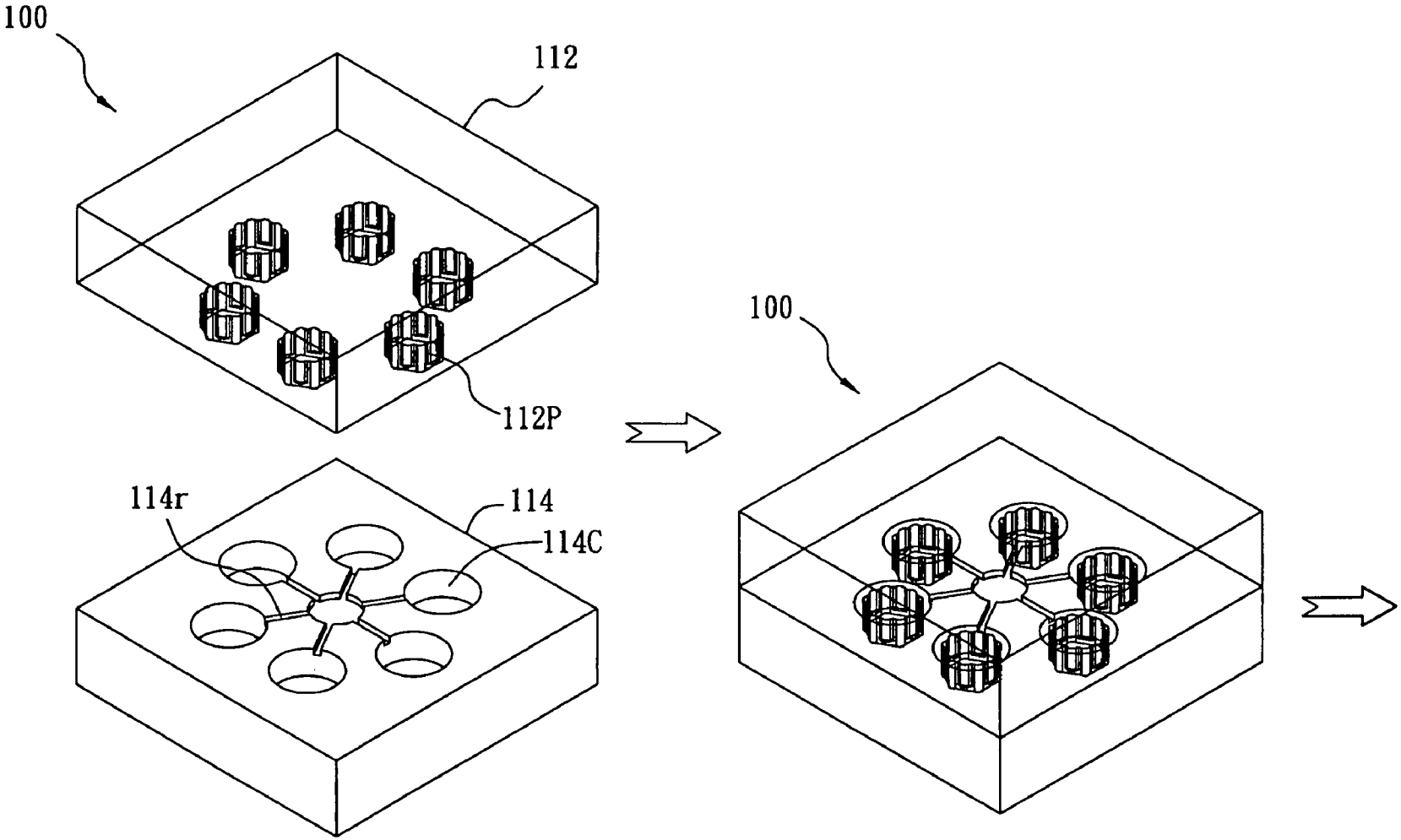
FIGS. 2A to 2I illustrate the manufacturing of ratchet wheels by using a powder injection molding process.

Referring to FIG. 2A, a master mold 100 consisting of upper and lower mold parts 112, 114 is prepared. The upper mold part 112 has a number of posts 112*p* each of which has a sidewall which is complementary in shape to a driving recess 154 of a finished product 150 of a ratchet wheel (see FIG. 2I). Preferably, each of the sidewall of posts 112*p* has a dodecagonal cross section such that the driving recess 154 of the finished product 150 is in a dodecagonal shape. The lower mold part 114 has a number of round cavities 114*c*, and preferably a common sprue 114*s* and runners 114*r* communicating with the round cavities 114*c*. The posts 112*p* are designed for being inserted into their respective round cavities 114*c* formed on the lower mold part 114. The upper and lower mold parts 112, 114 together define a molding cavity when assembled together, wherein the molding cavity comprises a number of product cavities enclosed by their respective round cavities 114*c* and posts 112*p*. Each of the product cavities is exactly the shape of a cast product 122 of the ratchet wheel (FIG. 2F) which will be explained below.

As shown in FIG. 2B, the upper and lower mold parts 112, 114 are then assembled together. A mixture of fine metal powders and a binder system (not shown) are kneaded in an extruding machine (not shown) under heat and pressure into a molten, flowable feedstock mixture (not shown). The molten kneaded feedstock mixture is then injected through a sprue into the molding cavity by an injection molding machine (not shown).

Figures 2C, 2D, 2E:
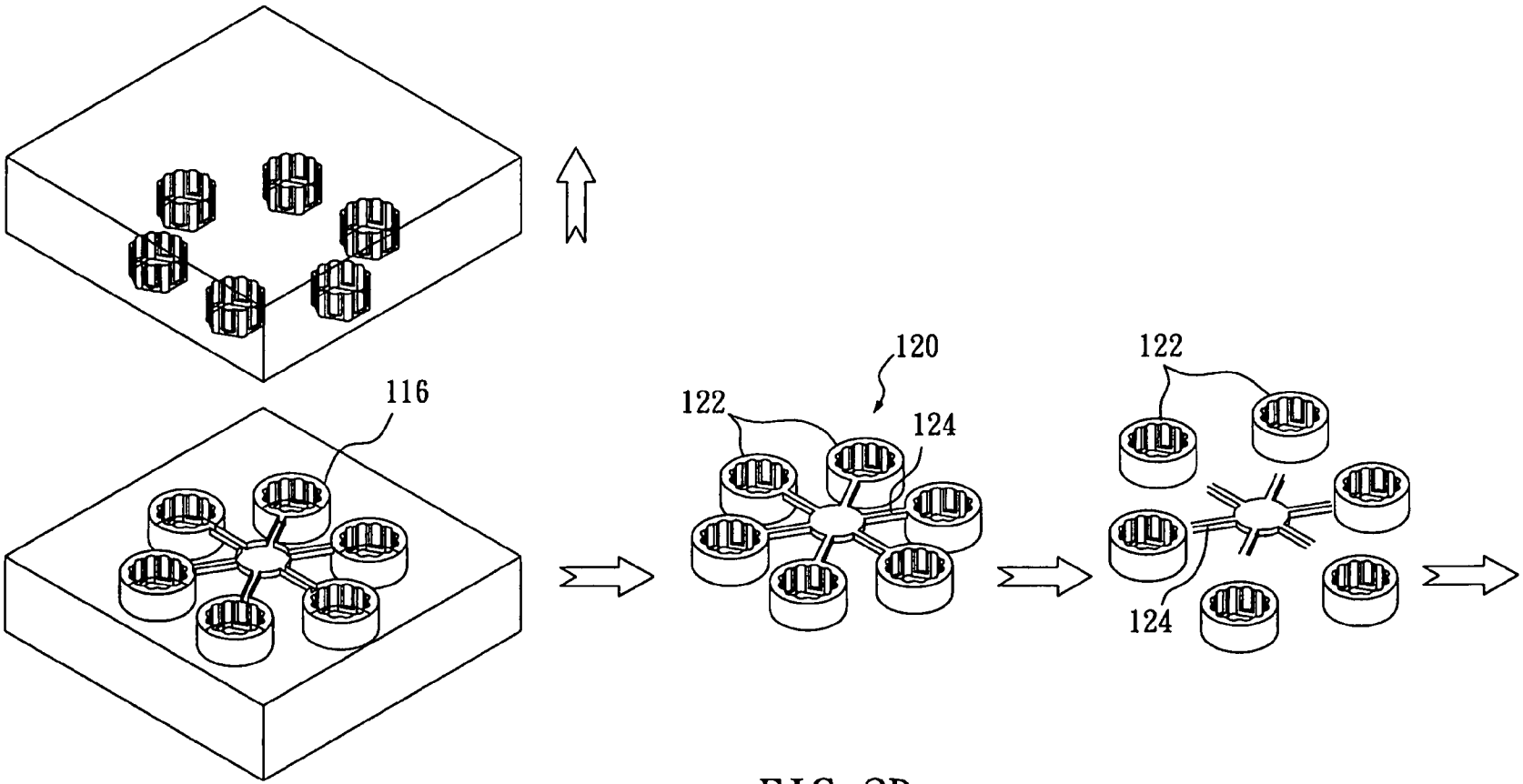

Once the feedstock mixture is molded, a green compact is achieved and then cooled. As shown in FIGS. 2C to 2D, the upper and lower mold parts 112, 114 are separated from each other so as to obtain the green compact 120 having a number of cast products 122 and branches 124 connecting the cast products 120.

Figure 2F:
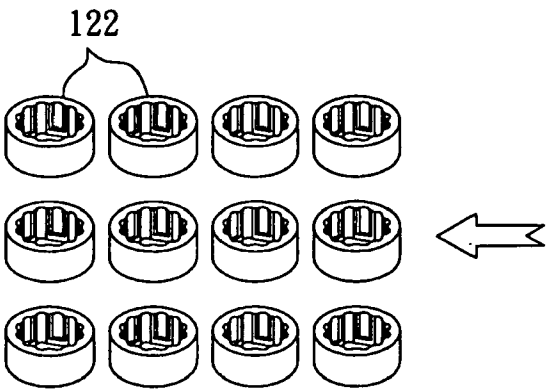
Figure 2G:
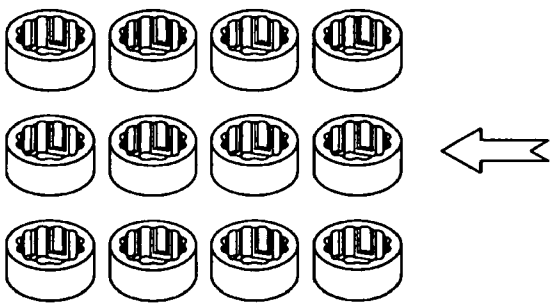

Referring to FIGS. 2E to 2F, the branches 124 and the flashes on the cast products 120 are then removed with the cast products 120 left only. Because the cast products 120 are very fragile after molding, a thermal debinding step is then used to remove the binding system (FIG. 2G). The debund parts are then sintered by raising their temperature to a point where atomic motion causes the powder metal particles to fuse.

Figure 2H:
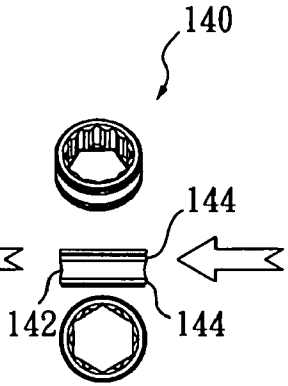
Figure 2I:
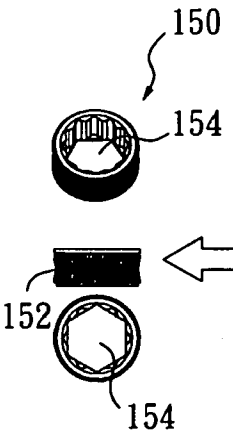

Referring to FIGS. 2H and 2I, each of the cast products 122 is processed by means of a CNC lathe (not shown) in order to define two annular grooves 144 in a sidewall 142 thereof such that it is made into an annular semi-product 140. The semi-product 140 is processed so as to define a plurality of teeth 152 in the sidewall by further machining steps such as by milling. Therefore, the semi-product 140 is made a finished product 150. If necessary, the finished product 150 can be further heat-treated to obtain the desired mechanical property.

Powder Metallurgy

FIGS. 3A to 3I illustrates the process of manufacturing ratchet wheels by powder metallurgy.

Figure 3C:
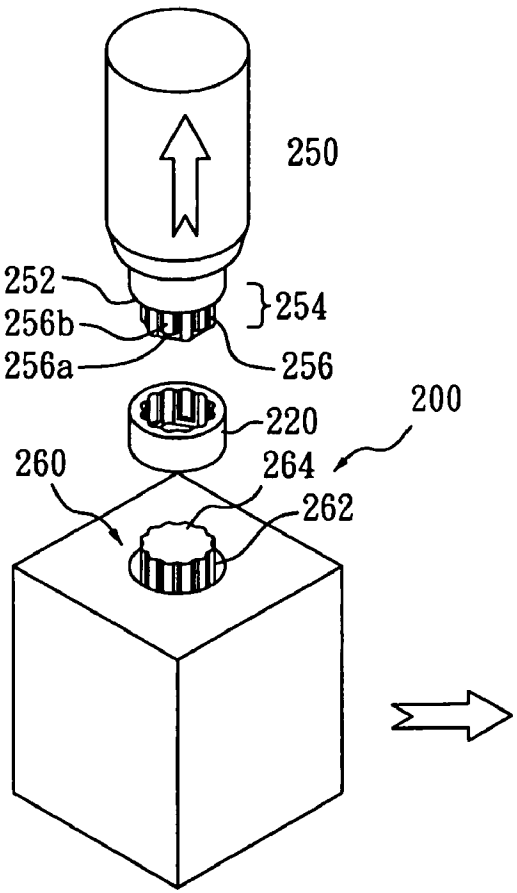
FIGS. 3A to 3I illustrate the manufacturing of ratchet wheels by using a powder metallurgy process.
Figure 3B:
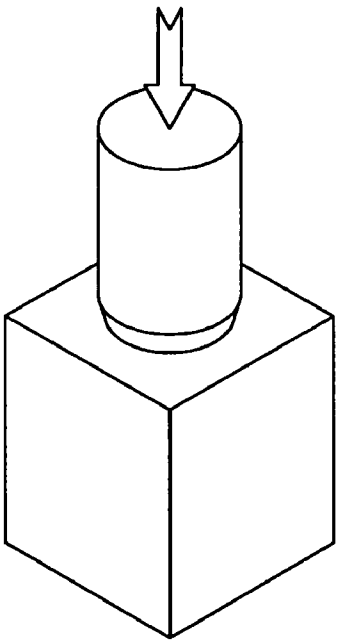
Figure 3A:
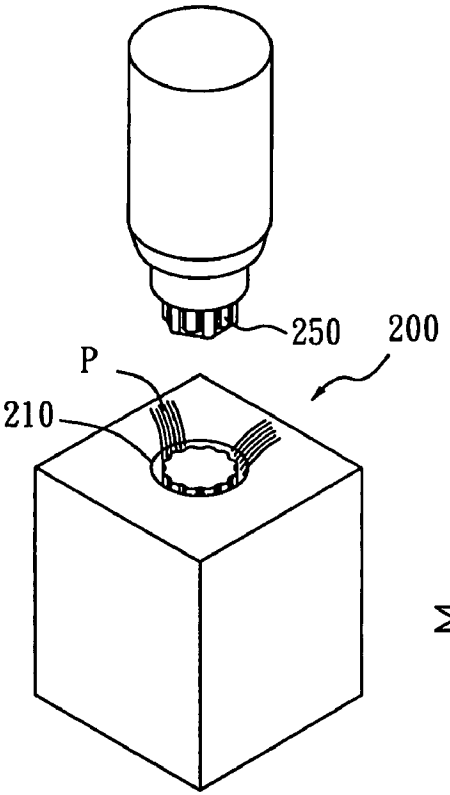

Referring to FIG. 3A, the process needs a die 200 and a forming machine (not shown) having upper and lower press parts 250, 260. The die 200 has a cylindrical molding cavity 210. The upper press part 250 comprises a pressing surface 252 and a forming core 254. The pressing surface 252 is sized to enclose the molding cavity 210 as it moves into the cavity 210. The forming core 254 has a sidewall 256 which is complementary in shape to a driving recess 244 of a finished product 240 of a ratchet wheel (see FIG. 3F). For example, the sidewall 256 may consist of six facets 256*a* and six corners 256*b* arranged in a way that the sidewall 256 has a dodecagonal cross-section such that the resultant driving recess 244 is easier to accommodate a square driven part of a sleeve. The forming core 254 has a generally smooth bottom surface 258. The lower press part 260 comprises a forming core 262 having a generally smooth bottom surface 264.

As shown in FIG. 3A, the process starts with loading metal powders P having a uniform density into the molding cavity 210 of the die 200. The metal powders P are then axially compacted under pressure by the upper and lower press parts 250, 260, as shown in FIG. 3B. Referring 3C, a green part 220 is thus formed, which achieves sufficient density and strength due to the pressing step such that it can be ejected from the die 200 after the upper press part 250 is removed out of the die 200. FIGS. 3G to 3I are cross-sectional explanatory views for explaining the pressing and ejecting steps of FIGS. 3B to 3C.

Figures 3D, 3E, 3F:
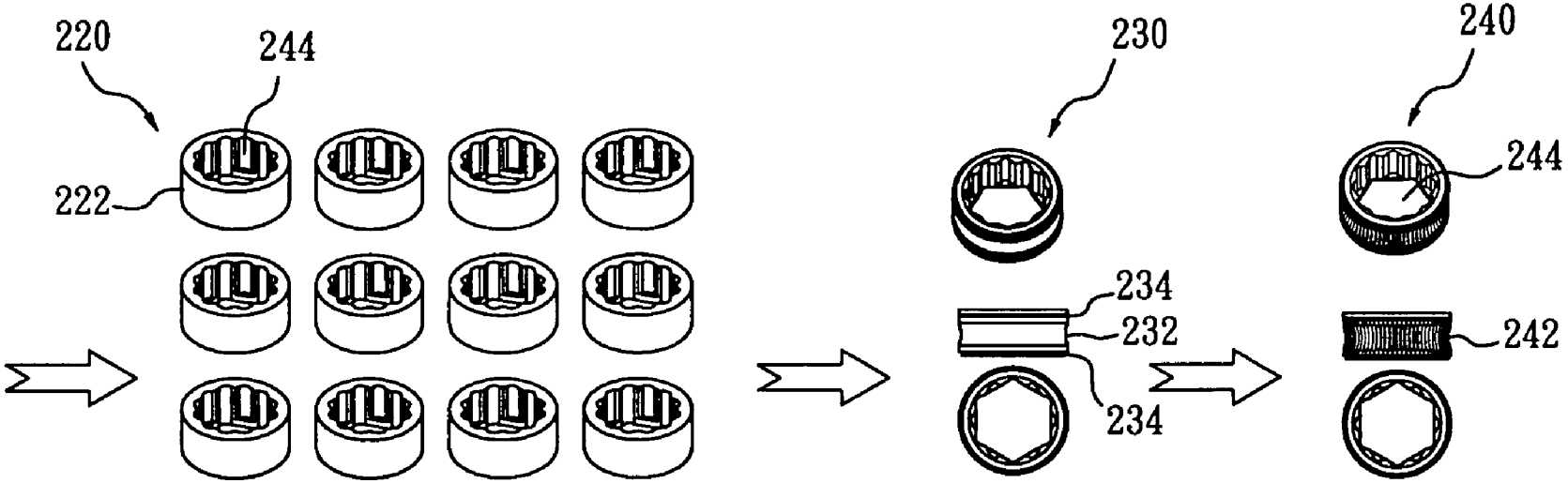
Figure 3I:
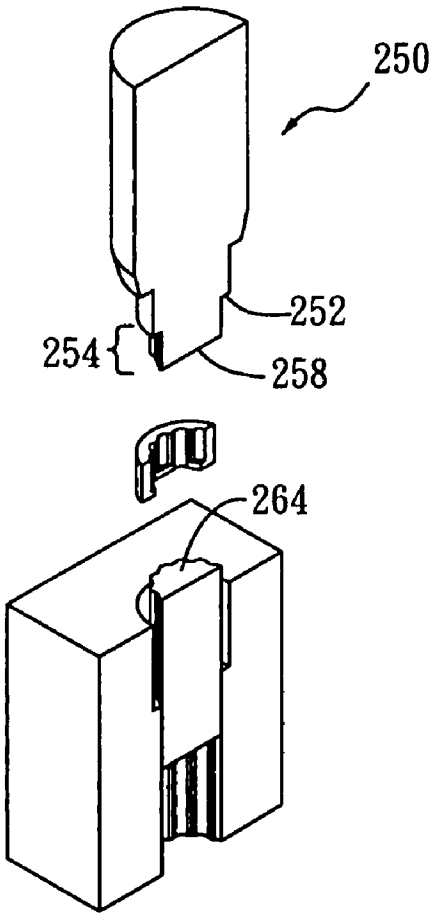
Figure 3H:
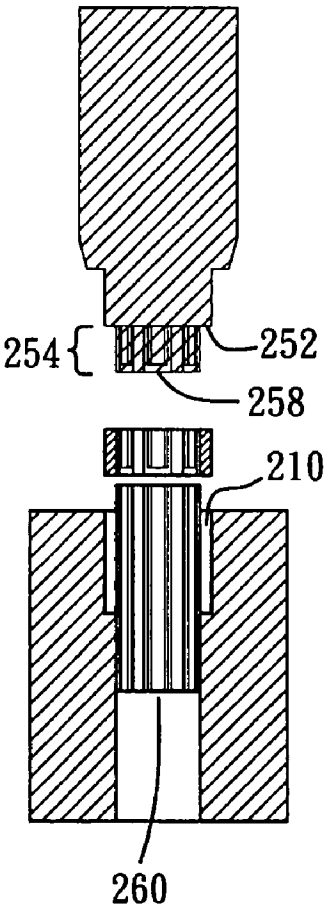
Figure 3G:
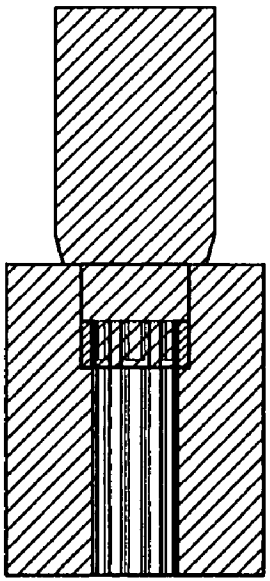

As shown in FIG. 3D, various green parts 220 can be made according to the above method and then heat-treated by sintering so as to gain strength, each having a smooth sidewall 222 and a driving recess 244. Referring to FIGS. 3E and 3F, each of the green parts 220 is processed by means of a CNC lathe (not shown) in order to define two annular grooves 234 in a sidewall 232 thereof such that it is made into an annular semi-product 230. The semi-product 230 is processed so as to define a plurality of teeth 242 in the sidewall by further machining steps such as by milling. Therefore, the semi-product 230 is made a finished product 240, having a toothed sidewall and a driving recess 244. If necessary, the finished product 240 can be further heat-treated to obtain the desired mechanical property.

Broaching

Referring to FIGS. 4A to 4E, a ratchet wheel can be manufactured by broaching.

Figure 4A:
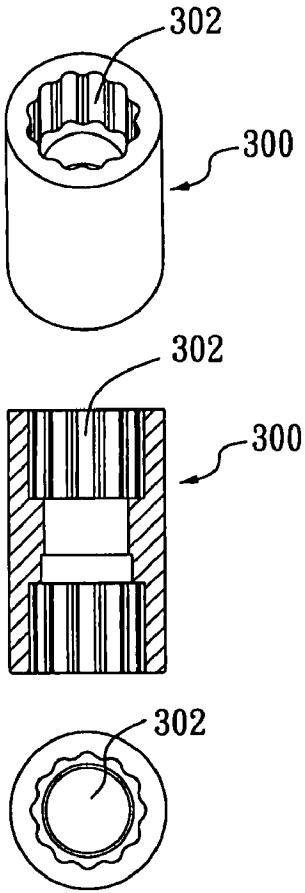
FIGS. 4A to 4E illustrate the manufacturing of ratchet wheels by using a broach cutting process.

As shown in FIG. 4A, a cylindrical forging billet 300 is prepared from hot or cold forging. The forging billet 300 has a thru hole 302 consisting of inter-communicating recesses which are pre-formed in a forging die (not shown). A broach 350 for shaping the thru hole 302 into a desired shape is also provided. The broach 350 is provided with teeth 352 which are complementary in shape to a driving recess 344 of a finished product 340 of a ratchet wheel (see FIG. 4E). The teeth 352 is preferably in a dodecagonal shape such that the resultant driving recess 344 is easier to accommodate a square driven part of a sleeve.

Figure 4B:
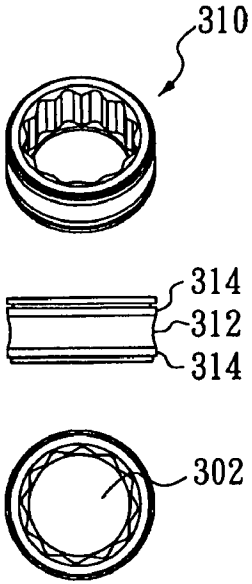
Figure 4C:
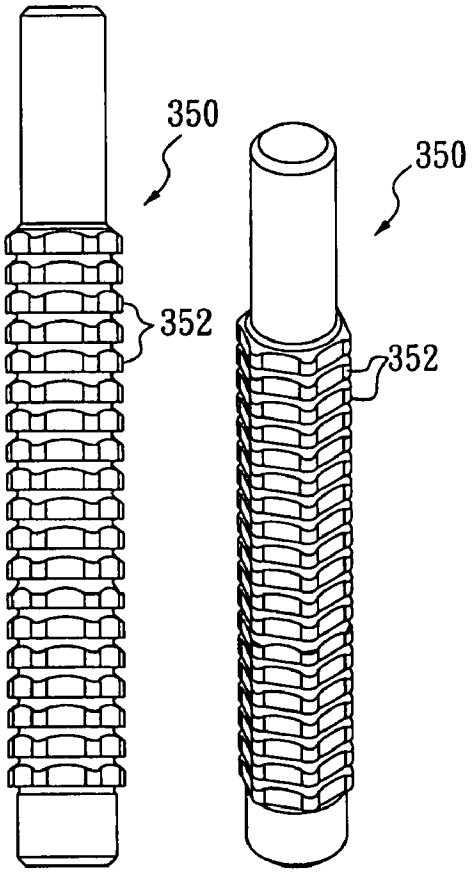
Figure 4D:
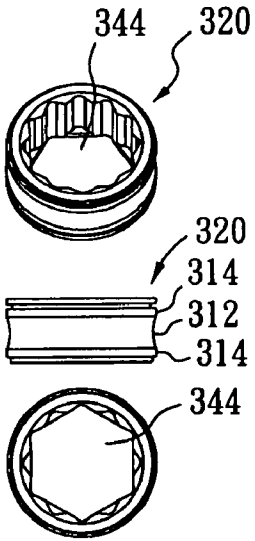
Figure 4E:
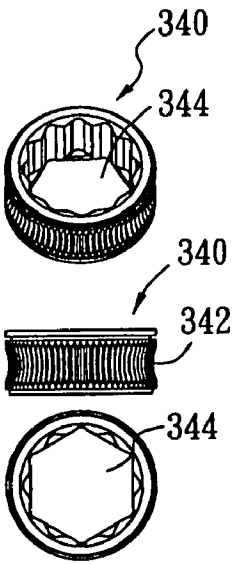

As shown in FIG. 4B, the forging billet 300 is then machined to an annular workpiece 310 (FIG. 4B) having a sidewall 312 with a suitable width and two annular grooves 314 on the sidewall 312 by a CNC lathe (not shown). Thereafter, the broach 350 is pushed or pulled through the workpiece 310 along the thru hole 302 so as to achieve a semi-product 320 having a driving recess 344 with the desired shape (FIG. 4D). Finally, the semi-product 320 is processed by further machining step(s) such as by milling so as to make a finished product 340 having a plurality of teeth 342 on the sidewall thereof. The finished product 340 can be further heat-treated to obtain the desired mechanical property.

Alternatively, the above process may be slightly modified by reversing the broaching step and the CNC lathe machining step. In details, after the forging billet 300 is formed, broach 350 is pushed or pulled through the forging billet 300 along the thru hole 302 so as to form a driving recess 344 with the desired shape. After the broaching step, forging billet 300 is machined to an annular semi-product 320 (FIG. 4D) having a sidewall 312 with a suitable width and two annular grooves 314 on the sidewall 312 by a CNC lathe (not shown). The semi-product 320 is processed by further machining step(s) such as by milling so as to make a finished product 340 having a plurality of teeth 342 on the sidewall thereof. The finished product 340 can be further heat-treated to obtain the desired mechanical property.

Punching

Referring to FIGS. 5A to 5E, a ratchet wheel can be manufactured by a punching process.

Figures 5A, 5B, 5C, 5D, 5E:
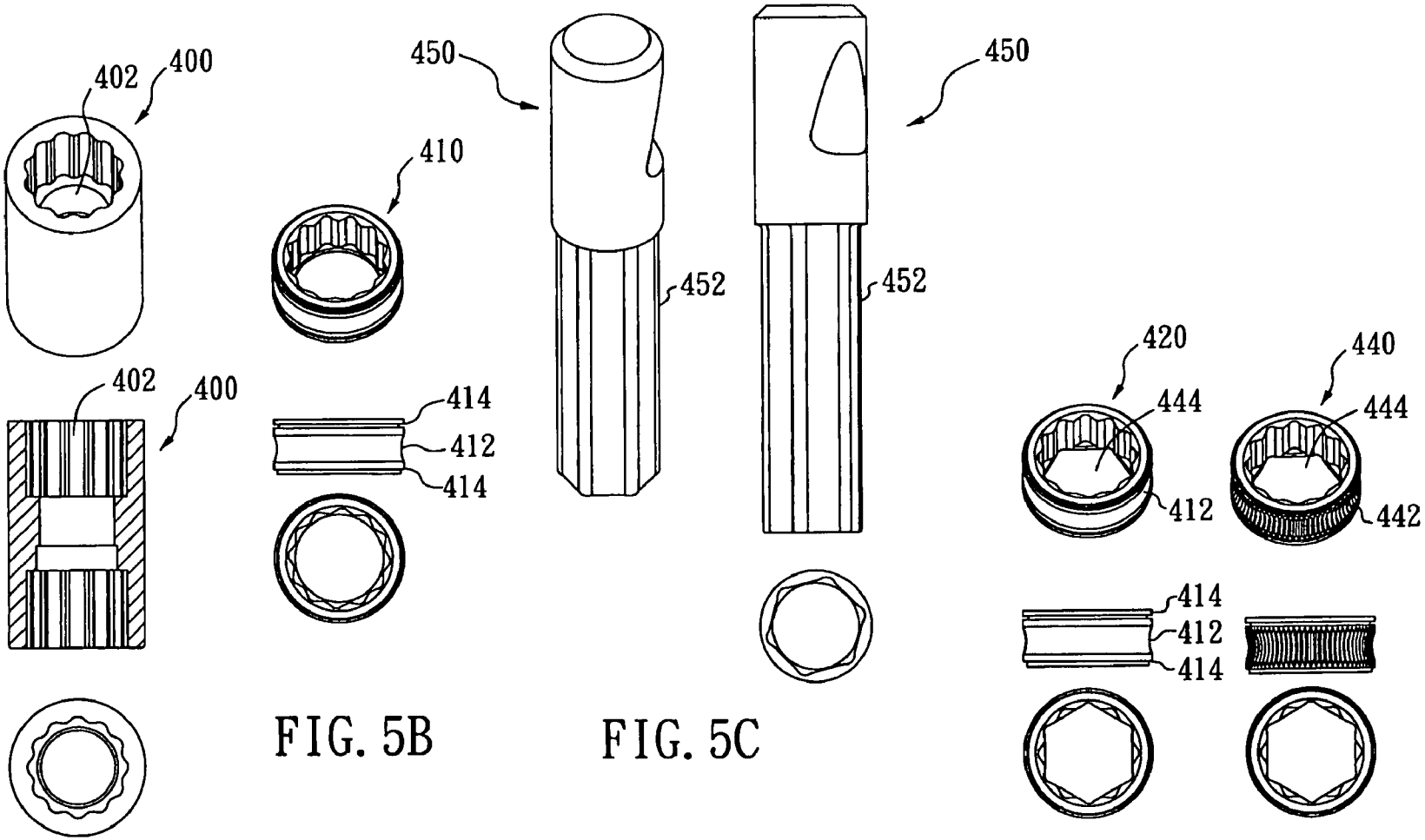
FIGS. 5A to 5E illustrate the manufacturing of ratchet wheels by using a punching process.

As shown in FIG. 5A, a cylindrical forging billet 400 is prepared by hot or cold forging. The forging billet 400 has a thru hole 402 consisting of inter-communicating recesses which are pre-formed in a forging die (not shown). A punch 450 for shaping the thru hole 402 into a desired shape is also provided (FIG. 5C). The punch 450 has a punching head of which a sidewall 452 is complementary in shape to a driving recess 444 of a finished product 440 of a ratchet wheel (see FIG. 5F). Preferably, the sidewall 452 of the punching head has a dodecagonal cross-section such that the thru hole 402 can be shaped into a driving recess 444 having a dodecagonal shape, which facilitates accommodation of a square driven part of a sleeve in the driving recess 444.

The forging billet 400 is then machined to an annular workpiece 410 (FIG. 5B) having a sidewall 412 with a suitable width and two annular grooves 414 on the sidewall 412 by a CNC lathe (not shown). Thereafter, the punch 450 is punched through the workpiece 410 along the thru hole 402 so as to achieve a semi-product 420 having a driving recess 444 with the desired shape (FIG. 5D). Finally, the semi-product 420 is processed by further machining step(s) such as by milling so as to make a finished product 440 having a plurality of teeth 442 on the sidewall thereof. The finished product 440 can be further processed with heat-treating step(s) to obtain the desired mechanical property.

The above process can be slightly modified by switching the punching step and the CNC lathe machining step. Specifically, after the forging billet 400 is formed, the punch 450 is pulled through the forging billet 400 along the thru hole 402 so as to form a driving recess 444 with the desired shape. After the punching step, the forging billet 400 is machined to an annular semi-product 420 (FIG. 4D) having a sidewall 412 with a suitable width and two annular grooves 414 on the sidewall 412 by a CNC lathe (not shown). The semi-product 420 is processed by further machining step(s) such as by milling so as to make a finished product 440 having a plurality of teeth 442 on the sidewall thereof. The finished product 440 can be further heat-treated to obtain the desired mechanical property.

All of the above are used to illustrate the preferred embodiments of the present invention, and are not intended for limiting the present invention. Any equivalent embodiment of other simple variations made according to the structure, features, spirit and the claims of the present invention should all be included within the scope of the following claims.

What is claimed is:

1. A process for manufacturing ratchet wheels comprising the steps of:

(1) forming a cylindrical forging billet by hot or cold forging, of which the forging billet having a thru hole consisting of inter-communicating recesses which are pre-formed in a forging die;

(2) providing a broach having teeth formed thereon;

(3) machining the forging billet into a workpiece having a sidewall with two annular grooves on the sidewall;

(4) forming a semi-product having a driving recess which is complementary in shape to the teeth by operating the broach through the workpiece along the thru hole and;

(5) forming a finished product having a plurality of teeth on a sidewall thereof by milling the semi-product.

2. A process for manufacturing ratchet wheels comprising the steps of:

(1) forming a cylindrical forging billet by hot or cold forging, of which the forging billet having a thru hole consisting of inter-communicating recesses which are pre-formed in a forging die;

(2) providing a broach having teeth formed thereon;

(3) shaping the thru hole into a driving recess having a desired shape by operating the broach through the forging billet along the thru hole;

(4) forming a semi-product having a sidewall and two annular grooves formed on the sidewall by machining the forging billet; and (5) forming a finished product having a plurality of teeth on the sidewall thereof by milling the semi-product.

* * * * *